US005934020A

United States Patent [19]

McCracken

[11] Patent Number: 5,934,020

[45] Date of Patent: Aug. 10, 1999

[54] WINDOW LOCK AND GUARD

[76] Inventor: Robert McCracken, 4377 N. Baldwin Ave., El Monte, Calif. 91731

[21] Appl. No.: 09/124,264

[22] Filed: Jul. 29, 1998

[51] Int. Cl.[6] ..... E06B 3/68

[52] U.S. Cl. ..... 49/56; 49/463; 160/222

[58] Field of Search ..... 49/50, 55, 56, 49/57, 63, 67, 463, 504, 505; 52/202; 160/222

[56] References Cited

U.S. PATENT DOCUMENTS

| | | | |
|---|---|---|---|
| D. 336,340 | 6/1993 | Medina . | |
| D. 341,213 | 11/1993 | Zvi . | |
| D. 345,806 | 4/1994 | Vyvoda . | |
| 618,145 | 1/1899 | Tremmel . | |
| 2,924,862 | 2/1960 | Pellicore . | |
| 3,167,828 | 2/1965 | Hutchisson, Jr. . | |
| 3,738,062 | 6/1973 | Ughi | 49/55 |
| 3,940,900 | 3/1976 | Russo | 49/504 X |
| 4,452,011 | 6/1984 | Trombettas | 49/56 |
| 4,993,187 | 2/1991 | Schweiss | 49/56 |
| 5,060,421 | 10/1991 | Castelli | 49/463 |
| 5,339,567 | 8/1994 | Pierpont | 49/55 |
| 5,461,827 | 10/1995 | Lofton | 49/55 |

*Primary Examiner*—Daniel P. Stodola
*Assistant Examiner*—Hugh B. Thompson

[57] ABSTRACT

An adjustable and pivotable window guard to be placed above a window inside a structure. The window guard provides an attractive appearance and excellent security. Hinge plates that have upwardly directed hinge tubes located thereon are secured on the inside wall proximal a window. A first window guard bracket having cooperating hinge bores is then placed on the hinge tubes so that it can pivot freely. The rectangular main central window guard is then placed over protruding members on the first window guard bracket and a second window guard bracket, also with similar protruding members, is inserted into the main central window guard on the opposite side from the first window guard bracket. Thus, all three of these elements are slidable horizontally in relationship to one another, which allows the user to adapt the device to variously sized windows. The second window guard bracket has a latch extending outwardly away from the main central window guard which fits into another latch receiving plate fixed to the wall on the opposite side of the window from the hinge plates. When novel locking pins are inserted into the first window guard bracket and the central window guard section in bores provided proximate the hinge plates, the assembly can not be pivoted open or forced because the locking pins butt up against the metal of the hinge plates. In alternative embodiments, multiple central sections may be placed in side by side relationship with one another to protect wider windows.

6 Claims, 8 Drawing Sheets

84
86
80
88
82
14
10
40
70
12
84
5
32
36
42
64
88
66
60
86
74
80
56
82
16
72
50
64
C
34
62
G
30
38
79
68
58
78
52
20
W

WINDOW LOCK AND GUARD

BACKGROUND OF THE INVENTION

1. Field of the Invention

The present invention relates to security devices. More specifically, it relates to a device that can be retrofitted to the inside of a window and that will prevent unauthorized entry to a building. At the same time, the device allows for various ornamental designs to be incorporated into the combination guard/lock.

2. Description of the Prior Art

Security at home and in one's place of work has become more and more of a concern. One of the most common modes of entry is to force or break a window to gain entry into a building. Alarms can be expensive and can be circumvented or disabled. Thus, many people have opted for providing a physical barrier of one sort or another in windows that are vulnerable to this form of entry. The problems of many of these types of devices is that they are unattractive, providing a closed in or "dungeon" effect if they are comprised of bars, making the homeowner or business owner feel as if they are locked in. Additionally, being fixed in place, they can make cleaning the glass very difficult and time consuming. Some prior art devices try to get around this problem by either being removable or pivotable away from the window for whenever cleaning or ventilation is required. The disadvantage here is that this can make them vulnerable to either being forced open or otherwise circumvented with a determined effort on the part of the criminal. The present invention seeks to address these problems of the prior art by providing a pivotable window guard and lock that is both attractive in appearance and that is not prone to being forced, even by the most determined malefactor.

A number of relevant patents were found in a search at the U.S. Patent and Trademark Office and they are discussed below.

U.S. Pat. Nos. Des. 341,213 issued to Zadok Zvi on Nov. 9, 1993, Des. 336,340 issued to Eleazar R. Medina on Jun. 8,1993, and Des. 345, 806 issued to Frank Vyvoda on Apr. 5, 1194 are all directed towards various decorative window grills. These are clearly dissimilar from the present invention in that none of them show the unique removable locking bar features or the adjustability of the instant invention.

In U.S. Pat. No. 618,145 issued to Leonard Fremmel on Jan. 24, 1899 there is disclosed a cellar window construction. This is unlike the present invention as no adjustability to fit various sized windows is taught.

U.S. Pat. No. 2,294,862 issued on Feb. 16, 1960 to Albert R. Pellicore, there is disclosed a securing means for a window guard. Unlike the present invention, no removable locking pins are disclosed.

Next, in U.S. Pat. No. 3,167,828 issued to Clarence L. Hutchisson, Jr. on Feb. 2,1965 a security guard for windows is seen. This also shows a dissimilar locking mechanism than the instant invention.

Another relevant patent is U.S. Pat. No. 4,452,011 issued to David T. Trombettas on Jun. 5,1984. This is a grill type window gate apparatus that is also clearly unlike the present invention. There is no teaching of the device having the removable locking pins abutting the hinge plates, as is seen in the instant invention.

In U.S. Pat. No. 4,993,187 issued on Feb. 19,1991 to Kenneth K. Schweiss there is disclosed a releasable window guard assembly. There is no teaching of the pivoting or adjustable features seen in the present invention.

Another invention of interest is U.S. Pat. No. 5,339,567 issued on Aug. 23,1994 to John M. Pierpont et al. This is directed towards interior mounted security bars. As in the above mentioned patents, there is no disclosure of the novel locking mechanism of the present invention.

Lastly, U.S. Pat. No. 5,461,827 issued to Nathan Lofton on Oct. 31, 1995 discloses a telescoping window bar unit. This is also clearly dissimilar from the present invention in that there is no adjustability feature or removable locking pins that abut the hinge plates.

None of the above inventions and patents, taken either singly or in combination, is seen to describe the instant invention as claimed.

SUMMARY OF THE INVENTION

The present invention is an adjustable and pivotable window guard and lock that provides both an attractive appearance and excellent security. The window guard will be mounted to the inside of a home, office or structure, protecting unauthorized entry through the window. Hinge plates that have upwardly directed hinge tubes located thereon are secured on the wall next to a window. A first window guard bracket having cooperating hinge bores is then placed on the hinge tubes so that it can pivot freely. The rectangular main central window guard is then placed over protruding members on the first window guard bracket and a second window guard bracket, also with similar protruding members, is inserted into the main central window guard on the opposite side from the first window guard bracket. Thus, all three of these elements are slidable horizontally in relationship to one another, which allows the user to adapt the device to variously sized windows. The second window guard bracket has a latch extending outwardly away from the main central window guard which fits into another latch receiving plate fixed to the wall on the opposite side of the window from the hinge plates. When novel locking pins are inserted into the first window guard bracket and the central window guard section in bores provided proximate the hinge plates, the assembly can not be pivoted open or forced because the locking pins butt up against the metal of the hinge plates. In alternative embodiments, multiple central sections may be placed in side by side relationship with one another to protect wider windows.

Accordingly, it is a principal object of the invention to provide a novel window guard and lock that overcomes the disadvantages of the prior art.

Another object of the invention is to provide a novel window guard and lock that may be adjusted to fit variously sized windows.

It is another object of the invention to provide a novel window guard and lock wherein the central window guard section may have a number of different pleasing decorative grill designs to enhance the appearance of the window along with providing security.

Still yet another object of the invention is to provide a novel window guard and lock where novel locking pins are inserted into bores located proximate the hinge plates attached to the wall and these locking pins then prevent forcing of the guard by being pressed against the hinge plates.

Still yet another object of the invention is to provide a window lock and guard where the locking pins engagement within the apparatus and their abutment to the metal hinge plates prevents the wall or casement of the window from being damaged during an attempted forced entry.

And yet another object of the invention is to provide a window guard and lock wherein multiple central sections may be attached modularly, in a side by side relationship, to allow for wider windows to be guarded.

These and other objects of the present invention will become readily apparent upon further review of the following specification and drawings.

BRIEF DESCRIPTION OF THE DRAWING

Various other objects, features, and attendant advantages of the present invention will become more fully appreciated as the same becomes better understood when considered in conjunction with the accompanying drawing, in which like reference characters designate the same or similar parts throughout the several views, and wherein.

DETAILED DESCRIPTION OF THE PREFERRED EMBODIMENT

Figure 1:
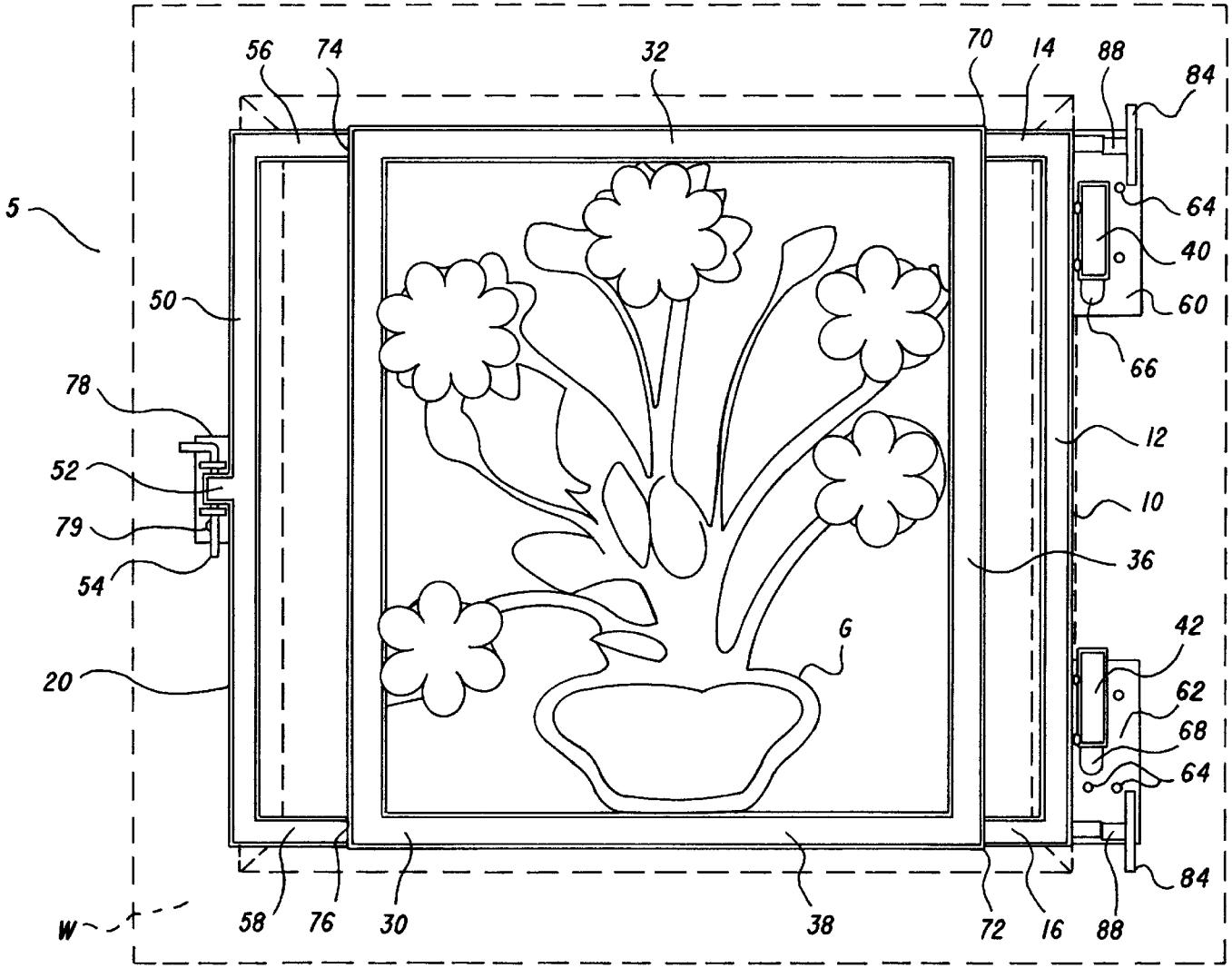
FIG. 1 is a front view of the invention installed in a window.
Figure 2:
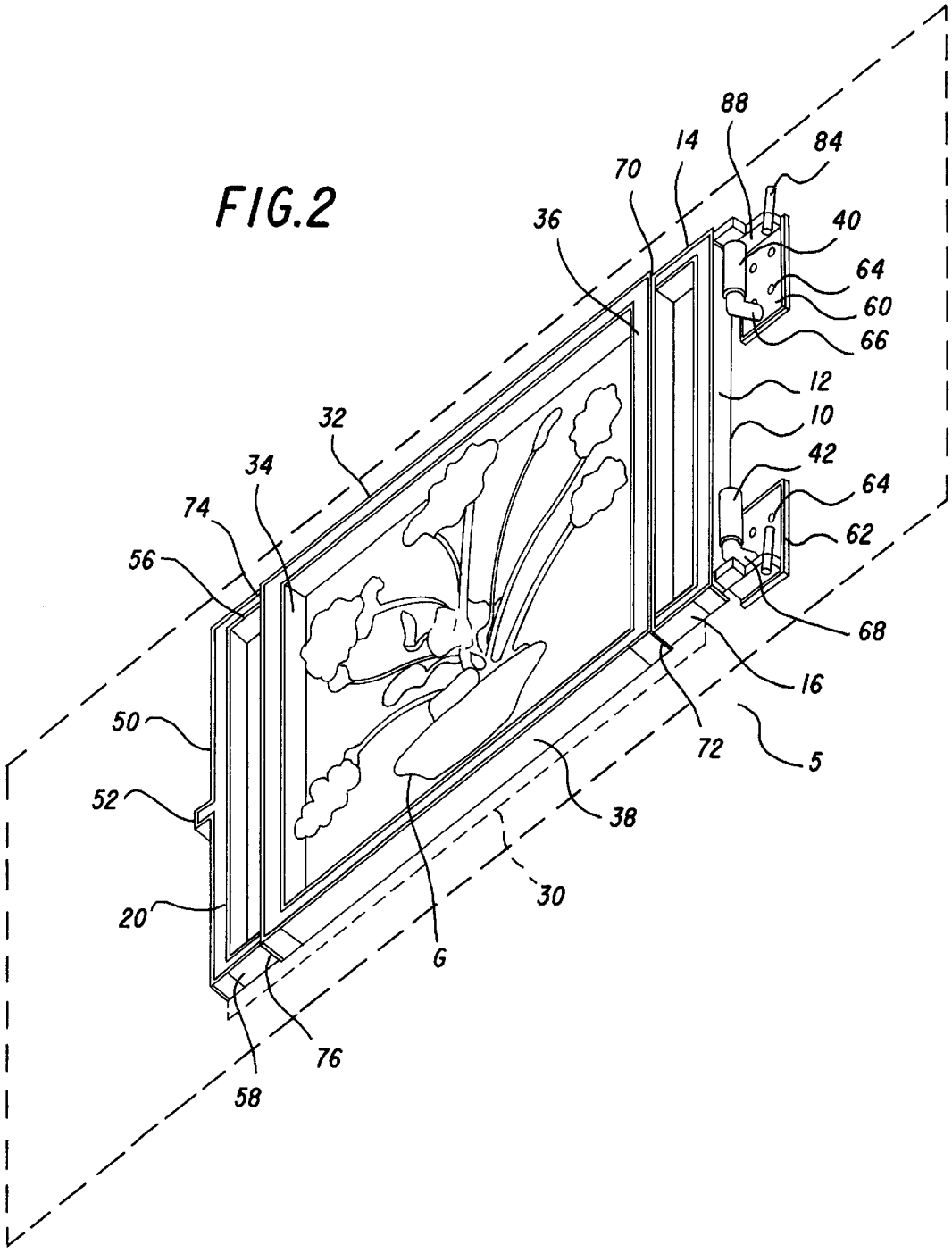
FIG. 2 is a perspective view of the apparatus in place and with the locking pins inserted.
Figure 3:
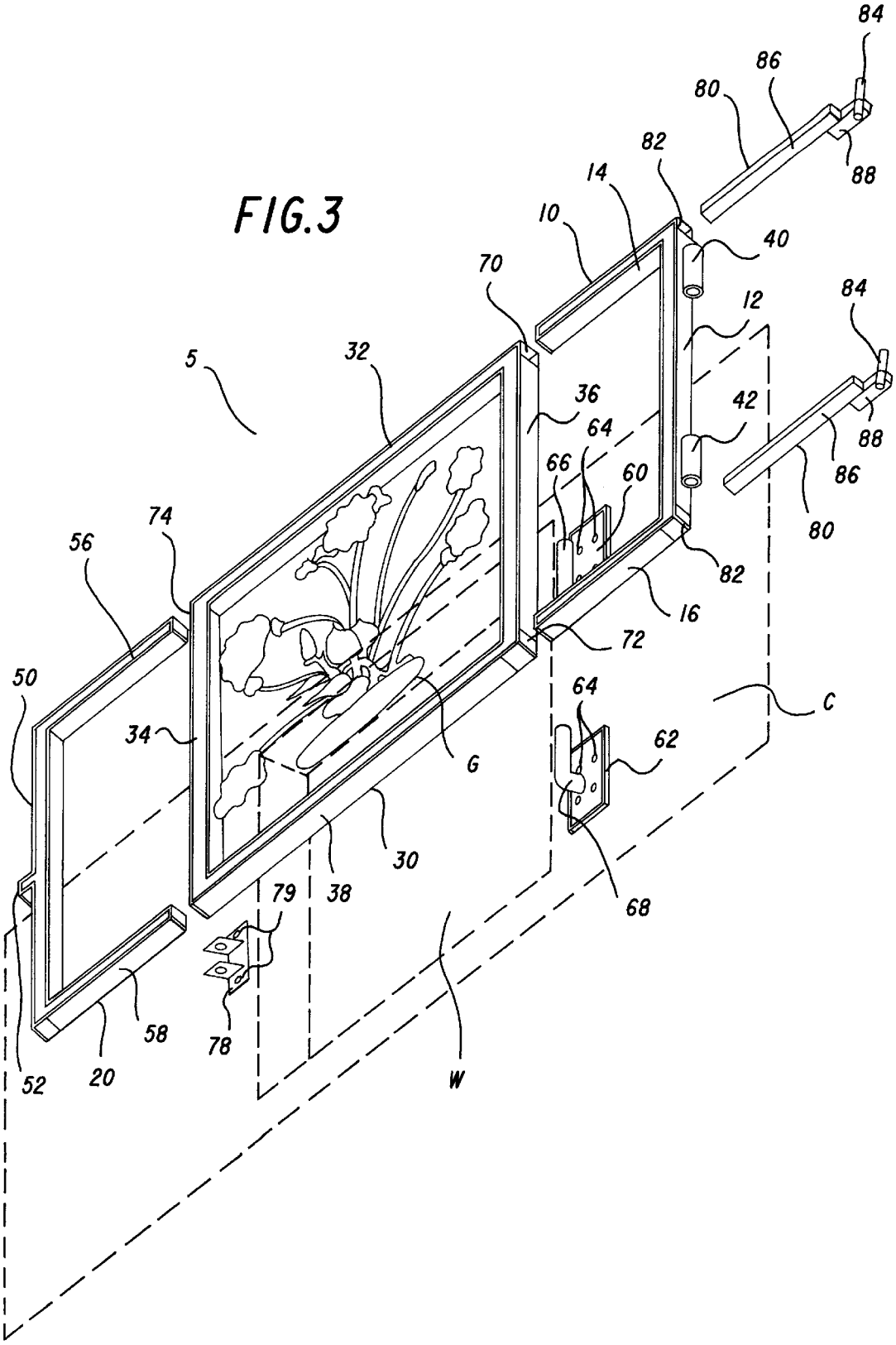
FIG. 3 is an exploded perspective view of the invention.
Figure 5:
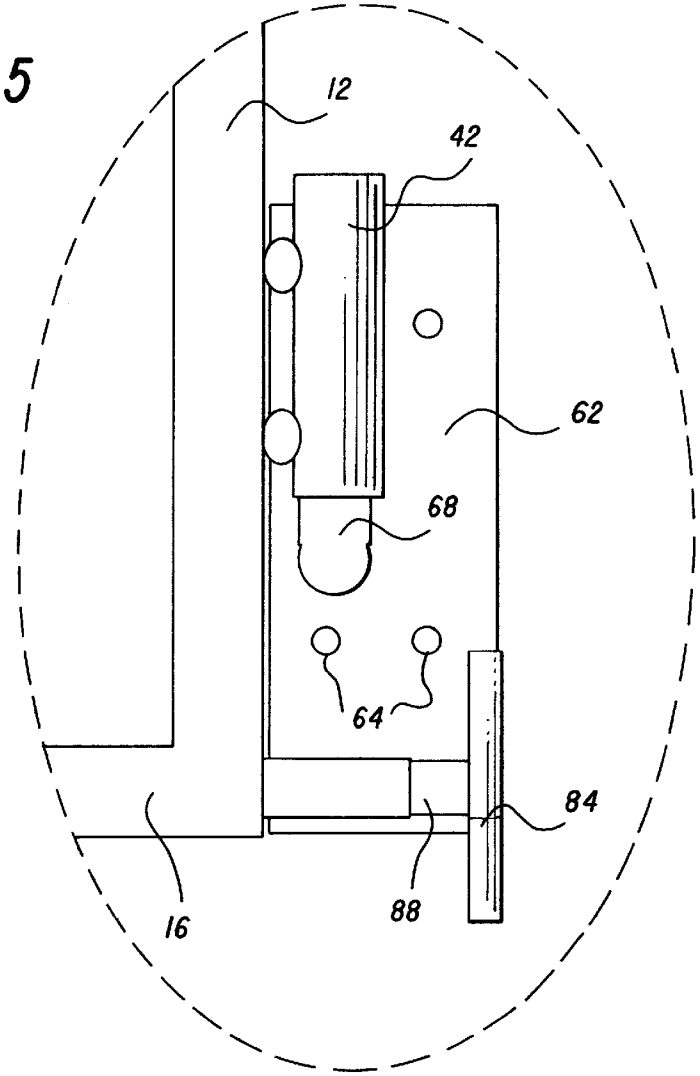
FIG. 5 is a closeup, partial front view of a hinge plate similar to FIG. 4, above.
Figure 7:
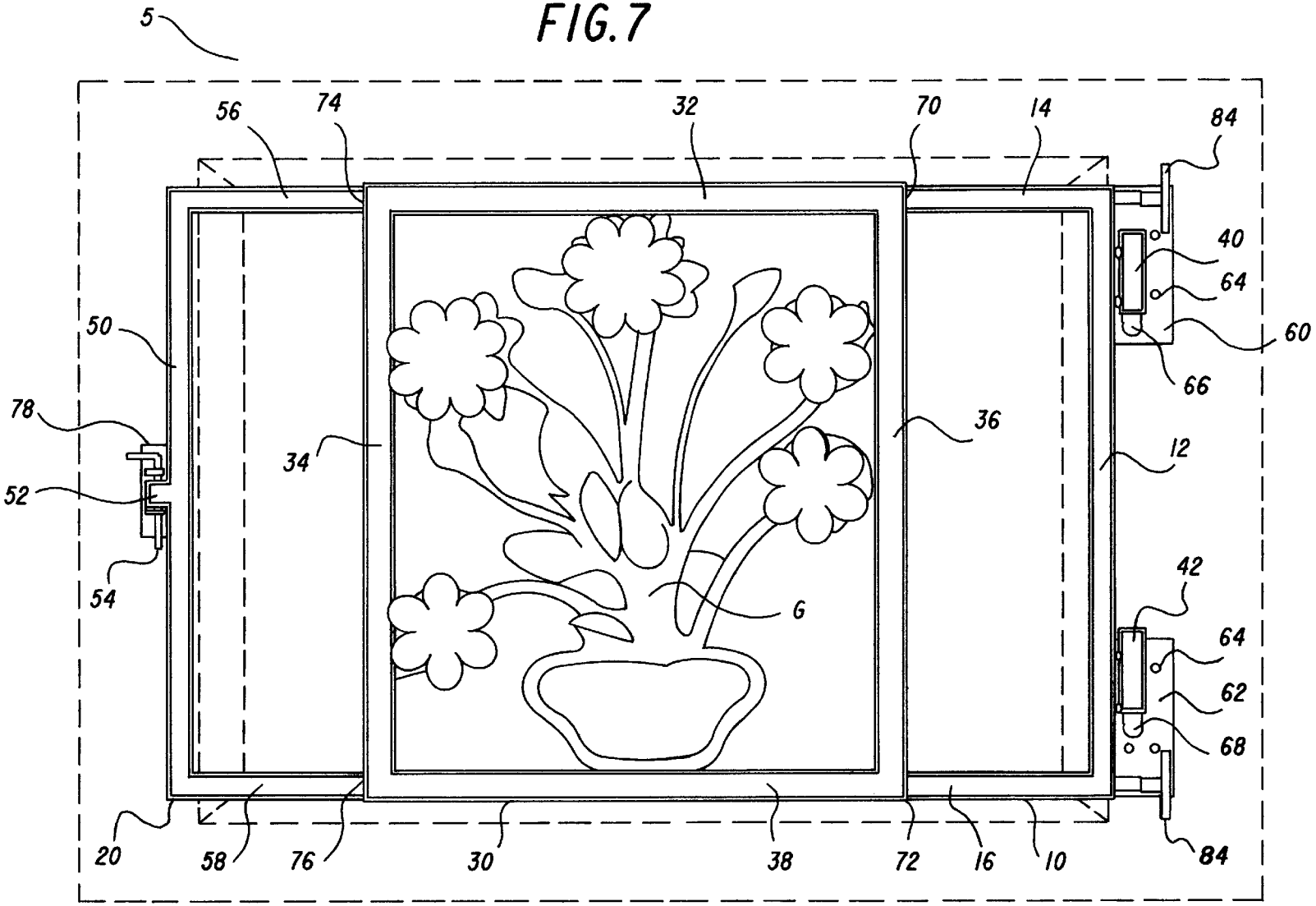
FIG. 7 is a front view of the present invention shown installed in a wider window to show the adjustability of the device.

Turning now to FIGS. 1, 2, and 3, the overall construction of the window guard 5 will be discussed. First window guard bracket 10 is disposed, when the apparatus is assembled, on the side nearest the hinge plates 60, 62, which will be discussed further below, when the method of assembling the device is addressed. Second window guard bracket 20 is located on the opposite side of the window W (best seen in dotted lines in FIG. 3). Between these two is the central window guard 30, which is generally rectangular in shape and includes central top member 32, side members 34 and 36, and bottom member 38. Located within all these members is decorative grill G. Turning to FIG. 3, the first window guard bracket 10 vertical member 12 to which are attached the top and bottom hinge tubes 40 and 42. First window guard bracket top member 14 and first window guard bracket bottom member 16 form a generally C-shaped affair in combination with first window guard bracket vertical member 12. First window guard bracket bottom member 16 and top member 14 fit into the corresponding first window guard bracket apertures 70, 72 that are located within central window guard 30. Second window guard bracket 20 is likewise constructed with a second window guard bracket vertical member 50 which carries the latch assembly 52 (discussed further hereinbelow), a top member 56 and a bottom member 58. In a manner similar to that of first window guard bracket top and bottom members 14, 16, these top and bottom members 56, 58 fit into the corresponding second window guard bracket apertures 74, 76 in central window guard 30. Notice that when these elements 10, 20, and 30 are all fit together, they are slidable horizontally in relation to one another. This allows the user to adjust the width of the device to allow it to fit in a wide variety of windows without the bother of customization. Compare, for example, FIGS. 1 and 7. By simply sliding first window guard bracket and second window guard bracket respective top and bottom members 14, 16, 56, and 58 within the corresponding apertures 70, 72, 74, and 76, different widths are possible. With extenders, as will be discussed further below, a plurality of central window guard sections 30 can be placed side by side to allow for very wide windows to be protected by the device.

Figure 4:
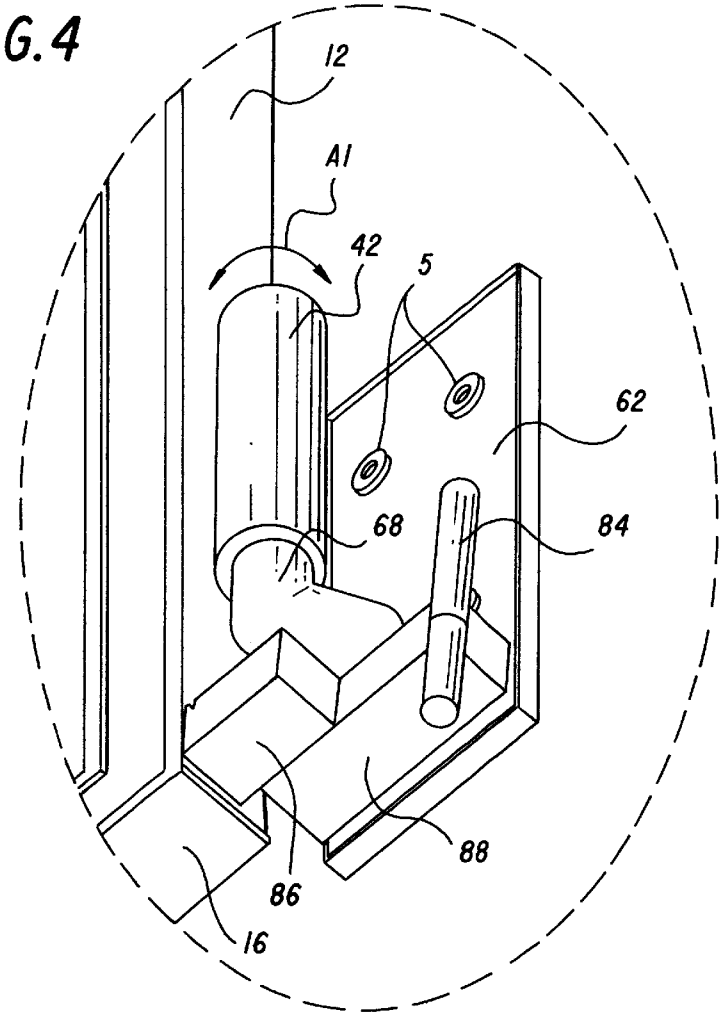
FIG. 4 is a closeup partial view of one of the hinge plates, with the first window bracket placed over the hinge tubes, and a locking pin inserted.
Figure 6:
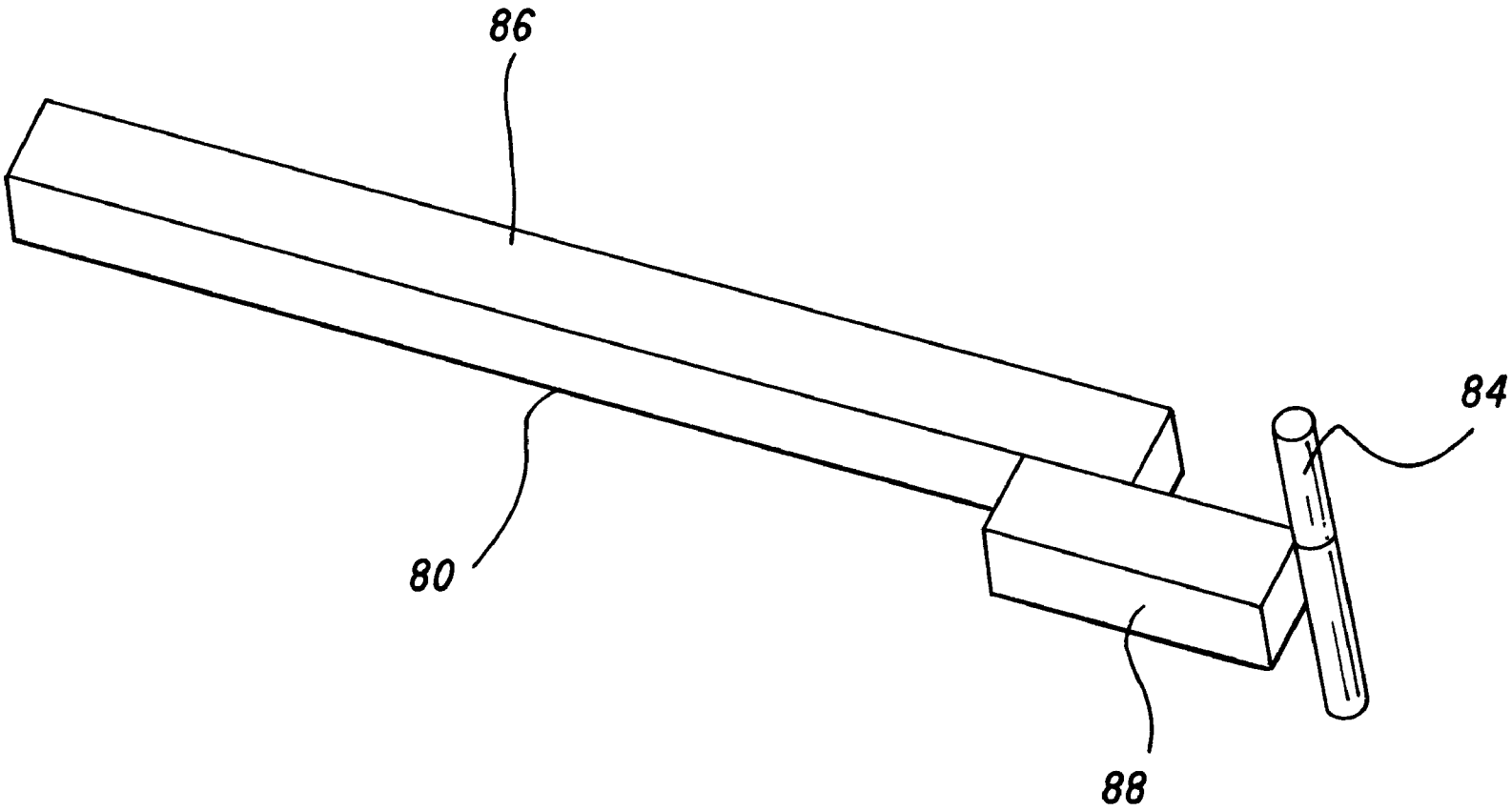
FIG. 6 is a view of one of the novel locking pins of the present invention.

The discussion now turns to the locking pins 80. In FIG. 6, the various portions of the locking pins can be most clearly seen. This includes the main body 86, hinge plate engagement portion 88, the handle 84, to allow the user to easily grasp and insert or remove the locking pin main body 86 into locking pin bores 82 (best seen in FIG. 3) which extend into both the top and bottom members 14, 16 of the first window guard bracket 10. Turning to FIG. 4 it can be seen that when pins 80 are in place, if a burglar or unauthorized person attempts to pivot open window guard 5, hinge plate engagement portions 88, abutting hinge plate 62 (in FIG. 4) will prevent any pivotal movement of the window guard 5 in the direction indicated by directional arrow A1. In the construction of locking pins 80, it should be clear that the size of hinge plate engagement portions, the amount of offset between the main body 86 and the portion 88 engaging the hinge plates 60, 62 would be dictated by the distance between the first window engagement bracket 10 and the hinge plates 60, 62. Notice also that the length of the locking pin main body 86 extending in to the locking pin bores 82 is a lever and the considerable length of the main body portion 86 will prevent all but the slightest movement. Locking pin bores 82 include a top aperture and a botton aperture as shown. The fact that the hinge plate engagement portions 88 abut directly against the metal hinge plates 60 or 62 prevents any damage to the casement C (seen in FIG. 3) in case of a forceful attempt at entry.

Figure 9:
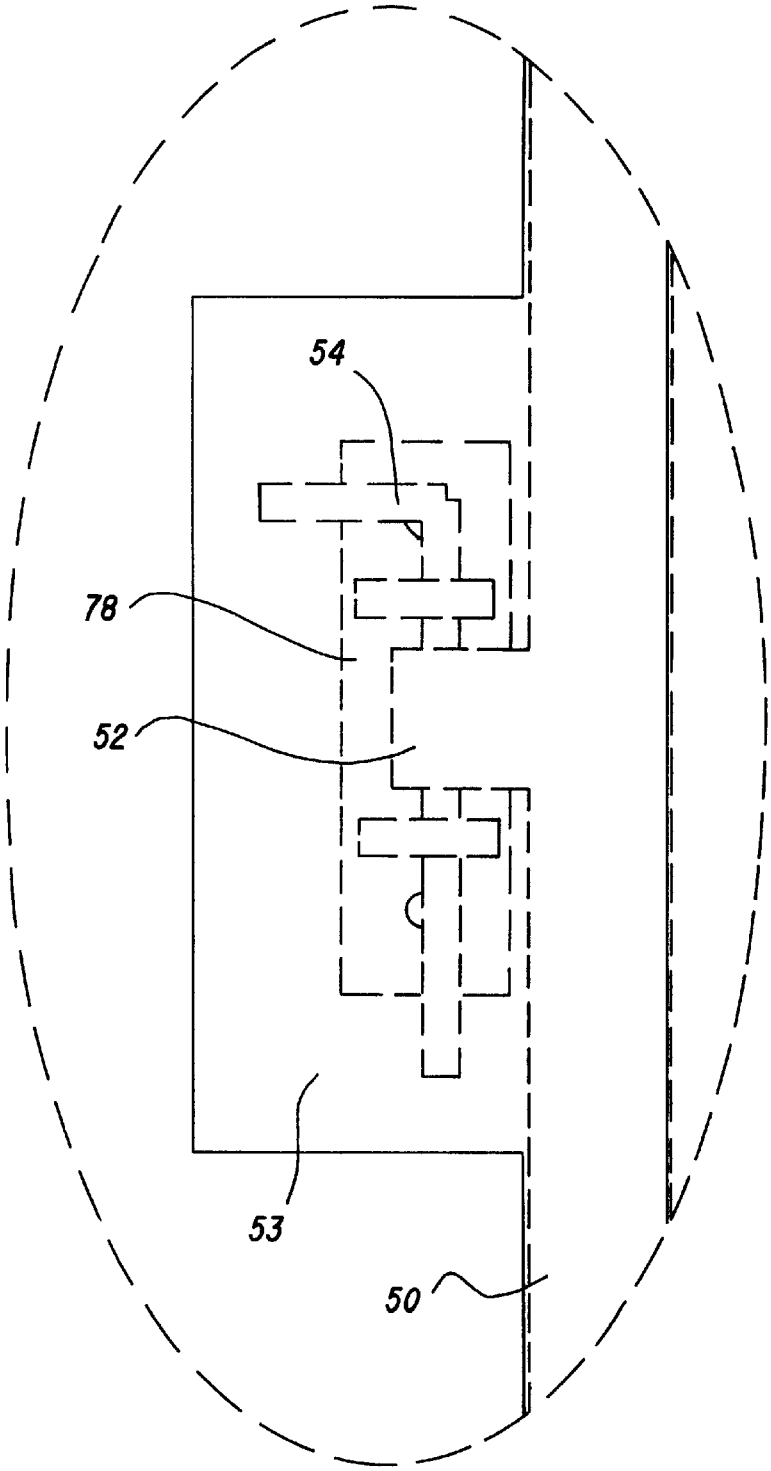
FIG. 9 is a closeup. partial view of an alternative latch having a protective cover.

The discussion now turns to the latch assembly 52 located on the vertical member 50 of the second window guard bracket 20. Latch assembly 52 has a bore therethrough tho accept latch pin 54. In combination with latch receiving plate 78 which has a pair of ears also including apertures to accept the pin 54, the window lock and guard 10 remains shut. It should be emphasized that there are many other methods of holding the apparatus shut and the instant invention is by no means limited to the latching means described. In an alternative embodiment, shown in FIG. 9, the latching assembly 52 is partially covered by a shield plate 53. This extends over the latch assembly and provides extra security against someone reaching through the grill G.

It also should be emphasized that the instant invention grill could be made up of a variety of various decorative designs and should in no way be construed as limited to the decorative patterns shown in this application.

Figure 8:
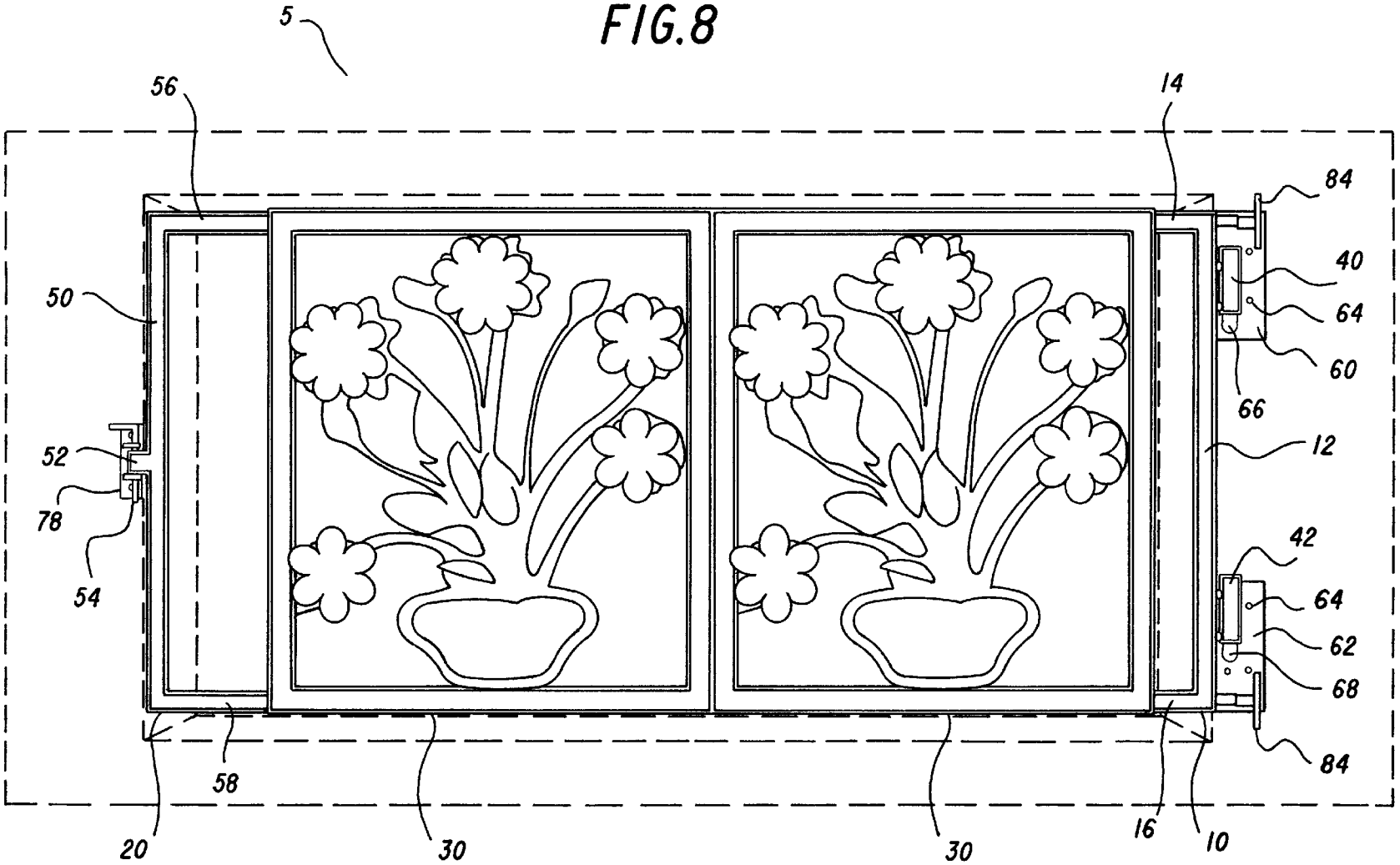
FIG. 8 is a view of an alternative embodiment of the invention, where central sections are modularly placed in a side by side relation, to guard even wider windows.

Looking now at FIG. 8, it can be appreciated that wider windows can also is be protected simply by putting straight connectors (not seen) sized similarly to top and bottom members 14,16, 56, and 58 between two sets of cooperating window guard bracket guard apertures 70, 72, 74, 76 located on central window guards 30 and 30'.

To make even clearer the function and utility of the present invention an abbreviated form of assembly instructions will be recited.

First, the user would hold first window guard bracket 10 in position, at the height that they wish to have it in the window. Marks are made and the hinge plates are attached to the wall, with care being shown to ensure that the device 5 is being installed at a level. In the embodiment described herein the attachment of the hinge plates 60, 62 is by means of threaded fasteners (indicated at S in FIG. 4) inserted into hinge plate apertures 64. First window guard bracket 10 is then placed on the hinges 66, 68 attached to the hinge plates 60, 62 by means of the top and bottom hinge tubes 40 and 42. Before or after this has happened, top and bottom members 14,16 of first window guard bracket 10 are inserted into first window guard bracket apertures 70, 72 on central window guard 30. Second window guard 20 top and bottom members 56, 58 are then inserted into the second window guard bracket apertures 74, 76. The latch receiving plate 78 is placed over the latch assembly 52 and latch pin 54 holds them together. window guard 5 is then pivoted shut and the wall can be marked for placement of the threaded members (not shown) to be inserted through latch receiving plate apertures 79. Latch receiving plate 78 is then attached to the wall by these means and latch pin 54 is inserted. If locking pins 80 are then inserted into locking pin bores 82, it will be extremely difficult for a burglar to enter through the window thus protected.

It is to be understood that the present invention is not limited to the embodiments described above, but encompasses any and all embodiments within the scope of the following claims.

I claim:

1. A window guard to be mounted inside a structure atop a window comprising, a first plate and a second plate are adapted to be mounted proximal the first side of a window, said first plate and said second plate each including a generally J-shaped pin depending therefrom, a first window guard bracket, said window guard bracket including a first and second mating means to each to receive said generally J-shaped pins therein, said first window guard bracket including a top aperture and a bottom aperture, a first locking pin and a second locking pin, said first locking pin slidably disposed in said top aperture, said first locking pin including a first engagement portion, said first engagement portion abutting against said first plate, said second locking pin slidably disposed in said bottom aperture, said second locking pin including a second engagement portion, said second engagement portion abutting against said second plate, whereby when an attempt is made to open said window guard from outside the structure, said first and second portion will engage said first and second plate respectively, preventing said window guard from opening, thus preventing egress through the window.

2. A window guard as claimed in claim 1 including, a central window guard slidably attached to said first window guard bracket;

a second window guard bracket slidably attached to said central window guard, said second window guard bracket including a latching means for latching said window guard to a receiving means secured proximal the second side of the window.

3. A window guard as claimed in claim 2 wherein said central window guard bracket includes a plurality of bars centrally disposed therein, said plurality of bars forming a barrier.

4. A window guard as claimed in claim 3 wherein said plurality of bars have an ornamental appearance.

5. A window guard as claimed in claim 1 wherein when said first locking pin and said second locking pin are removed, said window guard is free to pivot to an open position, permitting access to the window.

6. A window guard as claimed in claim 1 wherein when said first locking pin and said second locking pin are removed, said window guard may be completely removed from said J-shaped pins, permitting access to the window.

* * * * *